United States Patent [19]

Sakakibara

[11] Patent Number: 4,464,071

[45] Date of Patent: Aug. 7, 1984

[54] DETENT APPARATUS FOR PRINT WHEEL

[75] Inventor: Kenji Sakakibara, Nagoya, Japan

[73] Assignee: Brother Kogyo Kabushiki Kaisha, Nagoya, Japan

[21] Appl. No.: 469,997

[22] Filed: Feb. 24, 1983

Related U.S. Application Data

[63] Continuation of Ser. No. 246,394, Mar. 23, 1981, abandoned.

[30] Foreign Application Priority Data

Apr. 15, 1980 [JP] Japan ..... 55-50195

[51] Int. Cl.[3] ..... B41J 1/30

[52] U.S. Cl. ..... 400/144.2; 400/154.5; 400/163; 318/685; 318/696

[58] Field of Search ..... 400/144.2, 902, 903, 400/154.5, 163; 318/685, 696

[56] References Cited

U.S. PATENT DOCUMENTS

| | | | |
|---|---|---|---|
| 3,707,214 | 12/1972 | Ponzano | 400/144.2 |
| 3,840,105 | 10/1974 | Kittredge | 400/144.3 |
| 4,035,708 | 7/1977 | Schaff | 318/696 |
| 4,147,968 | 4/1979 | Goble | 318/696 |
| 4,198,169 | 4/1980 | Stuiber et al. | 400/144.2 |

OTHER PUBLICATIONS

"Low Inertia Daisy Wheel Printer"; *IBM Technical Disclosure Bulletin; N. Leon; vol. 22, No. 2; Jul. 1979; pp. 809–810.*

*Primary Examiner*—Edgar S. Burr
*Assistant Examiner*—David A. Wiecking
*Attorney, Agent, or Firm*—Moonray Kojima

[57] ABSTRACT

A serial printer comprising a print wheel having numerous type bearing spokes, each of which extends radially and which is provided with a type element on the tip of the spoke, a stepping motor for rotating the print wheel, a print hammer for striking the desired spoke behind the type element during printing operation, a positioning means for guiding a selected type element to a printing point during the striking operation of the print hammer, and a control circuit for regulating the driving of the stepping motor and the print hammer. The control circuit causes the stepping motor to move the selected type element to a position whereat the type element is struck by the print hammer. The control circuit suspends the energize-hold operation of the stepping motor at the moment that the type element is struck by the print hammer. This invention accurately positions the type element for substantially aligned printing operation, and greatly reduces damage to the spokes due to material fatigue.

10 Claims, 7 Drawing Figures

DETENT APPARATUS FOR PRINT WHEEL

This is a continuation of application Ser. No. 246,394, filed Mar. 23, 1981, now abandoned.

BACKGROUND OF THE INVENTION

1. Field of the Invention

This invention relates to serial printers and more particularly to improvements in a detent apparatus for serial printers having a print wheel with a plurality of type-bearing spokes.

2. Description of the Prior Art

In a serial printer having a disc-shaped print wheel, which has numerous type-bearing spokes located radially and provided with type elements on the tips of the spokes and which is rotated by a motor, a selected spoke having come to a printing position or point is struck behind the type element by a print hammer toward a platen to perform printing.

Printers, in which a positioning mechanism, consisting of a positioning projection and a positioning recess which cooperate with each other during the striking action of a print hammer, is provided between hammer and the spoke or between the spoke and a guide member for striking a selected type element against a printing point on a platen to obtain an orderly row of printed characters, have already been proposed. A printer disclosed in U.S. Pat. No. 3,442,365 exemplifies a printer having a positioning mechanism between the hammer and each spoke. Another printer disclosed in U.S. Pat. No. 3,983,985 exemplifies a printer having a positioning mechanism between each spoke and the guide member.

In such conventional printers, the print wheel is driven by a DC motor or an AC motor which is continuously rotating at a constant speed and the spoke is struck by the print hammer at the moment of the passing of the spoke by the printing position, or the print wheel is driven by a stepping motor having a number of steady-state positions corresponding to the total number of spokes and the spoke is struck by the print hammer while the stepping motor is energized to hold a type element opposite the printing position. However, one deficiency is that the positioning means might not always operate properly or the struck spoke might receive not only a force toward the platen, but also a turning force due to the rotary force or stopping force of the motor during the striking action of the print hammer. As a result, an orderly row of printed characters is not always obtained, or the damage to each spoke resulting from material fatigue, especially its butt portion, is accelerated.

To eliminate these deficiencies, each type element on the print wheel needs to be accurately positioned opposite the printing position during every printing action or operation. For this purpose, it is required that the print wheel be accurately shaped and a detector for detecting the rotational position of the print wheel have very high performance. When a stepping motor, appropriate to step-by-step action, is rotated in two directions to select a type element more quickly, the motor needs to be manufactured so as to minimize the difference between the steady-state positions in both directions of rotation of the motor. These criteria result in complicating the manufacturing and assembly work of serial printers and increasing their cost.

SUMMARY OF THE INVENTION

It is an object of this invention to provide an improved serial printer.

It is another object to provide a serial printer capable of substantially always printing in substantially always the proper printing position and thereby causing the printed characters to be substantially always aligned.

It is a further object to provide a means to control damage of the spoke on a print wheel, caused by material fatigue.

It is still a further object to provide a low cost serial printer which may be easily manufactured.

The foregoing and other objects are attained in the invention serial printer wherein a print wheel, provided with numerous radially extending type bearing spokes, is directly coupled to the rotor shaft of a stepping motor which is rotated in two directions. The serial printer is provided with a positioning means between each spoke and the print hammer or a guide member for striking a selected type element against a printing point on a platen. The rotation of the stepping motor is regulated by a control circuit to move a selected type element toward a position opposite to the printing point. After the type element is moved to the position, the motor is temporarily stopped and held in that position. The control circuit functions to cause the print hammer to strike the type element during the stoppage of the motor and functions to cut off an energizing signal to the stepping motor at the moment of the striking action of the hammer, to release the motor from the held state. For this reason, the print wheel directly coupled to the stepping motor under no holding force rotates slightly when the spoke is displaced by the positioning means to move the type element accurately to the printing point.

DETAILED DESCRIPTION OF PREFERRED EMBODIMENTS

Figure 1:
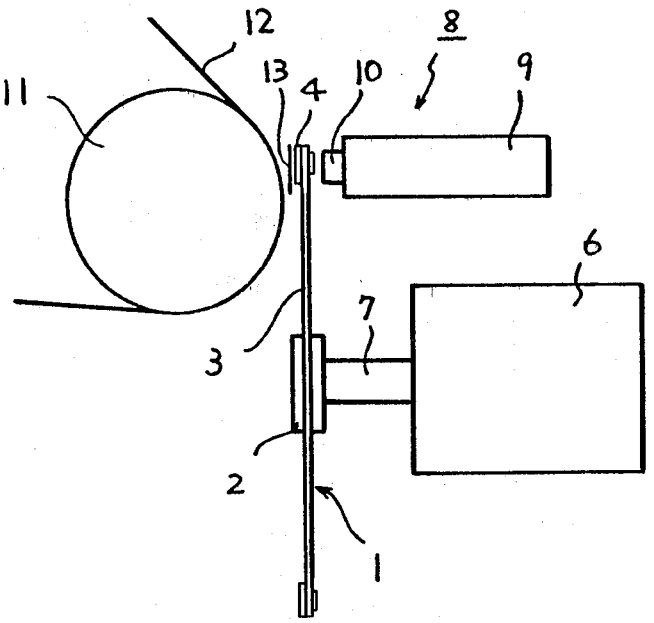
FIG. 1 is a partly schematic side view of a serial printer embodying the invention.
Figure 2:
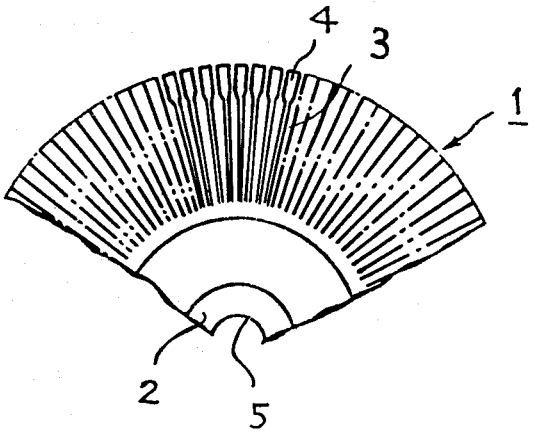
FIG. 2 is a fragmentary plan view of a print wheel for the serial printer depicted in FIG. 1.

In the illustrative embodiment depicted in FIG. 1, a print wheel 1 has numerous type bearing spokes 3, each of which extends radially from a hub 2 (as shown in greater detail in FIG. 2). One type element 4 is provided on the tip of each spoke 3. The entire print wheel 1 may be integrally made of synthetic resin. All the type elements 4 are located on an identical circle (i.e. at substantially the same radius) centering a fitting opening 5 provided in the center of hub 2. The print wheel 1 is directly mounted on or removed from the rotor shaft 7 of a stepping motor 6 (see FIG. 1) by means of the opening 5 of the hub 2.

A print hammer unit 8, which is secured together with the motor 6 on a carriage (not shown), comprises a solenoid 9 and a hammer 10. A type element 4 having come to a printing position opposite a print line on print paper 12 mounted on a platen 11 is struck by the hammer 10 on the back of the spoke 3. As a result, the type element 4 moves through an ink ribbon 13 against print paper 12 to print a predetermined character.

Figure 3:
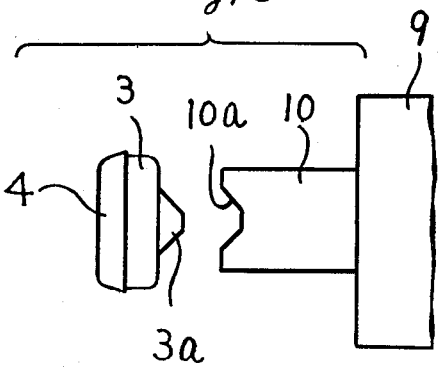
FIG. 3 is an enlarged top view of the hammer and one of the type bearing spokes of the printer depicted in FIG. 1.

The stepping motor 6 has a plurality of steady state positions whose number is equal to that of the type elements 4 on the print wheel 1. Therefore, in whichever steady state position motor 6 is energized and held, one spoke 3 is located in a printing position to be struck by hammer 10. However, in this printer, since there is avoided an undesirable cost increase due to the manufacture, mutual assembly and adjustment of the print wheel 1, the stepping motor 6 and a position detecting mechanism therefor (not shown), there is little probability that the selected type element 4 will be held in a position accurately opposite to the printing point on the paper 12, by the stepping motor 6. For this reason, the printer is provided with a recess 10*a* (see FIG. 3) on the tip of hammer 10 and with a projection 3*a* on the side of each spoke 3 opposite the type element 4. The recess 10*a* and the projection 3*a* constitute a positioning means similar to that disclosed in U.S. Pat. No. 3,442,365. As a result, although the type element 4 may not be accurately positioned opposite a printing point on the printing paper 12, the type element 4 is struck against the proper printing point by action of the positioning means during the striking action of hammer 10. The carriage is moved forth by one character along the platen 11 in parallel therewith after every printing operation.

Figure 4:
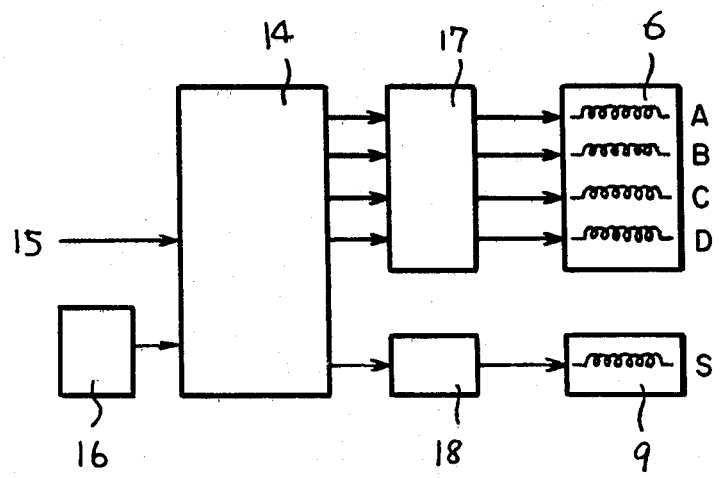
FIG. 4 is a schematic block diagram of the control circuit used in the printer depicted in FIG. 1.

The printing action of a print mechanism described above is effected through an electronic control system briefly shown in FIG. 4. Control circuit 14 comprises a microprocessor, a ROM and a RAM to perform prescribed programmed data processing. A control circuit similar to circuit 14 has been already frequently utilized as a control means for a printer of the type described. In response to an input command 15 and a detection signal from a rotational position detector 16 for the stepping motor 6, control circuit 14 supplies a driving signal to a drive circuit 17. Drive circuit 17 energizes stepping motor 6 having four energized poles A, B, C and D for moving a selected type element 4 to a position in which element 4 may be struck by hammer 10. After the driving signal is supplied to drive circuit 17 and the selected type element 4 is moved to the position to be struck by hammer 10, control circuit 14 feeds a driving signal to another drive circuit 18 for solenoid 9 of print hammer unit 8 to drive hammer 10 toward platen 11. At that moment, control circuit 14 temporarily stops energizing stepping motor 6. After the striking action of the hammer 10 is completed, the control circuit 14 acts to again energize stepping motor 6. The selected type element 4, even if not located accurately in a print position by the stepping motor 6, is moved toward an accurate printing point by the action of the positioning means based on the movement of the hammer 10 and is hit on platen 11. At that time, spoke 3 receives a force in a rotating direction and stepping motor 6 directly coupled to print wheel 1 is not energized. Thus, if the force in the rotating direction is considerably strong, print wheel 1 rotates slightly together with stepping motor 6 to escape from the force. As a result, damage accelerating fatigue is not stored in the spoke.

Figure 5:
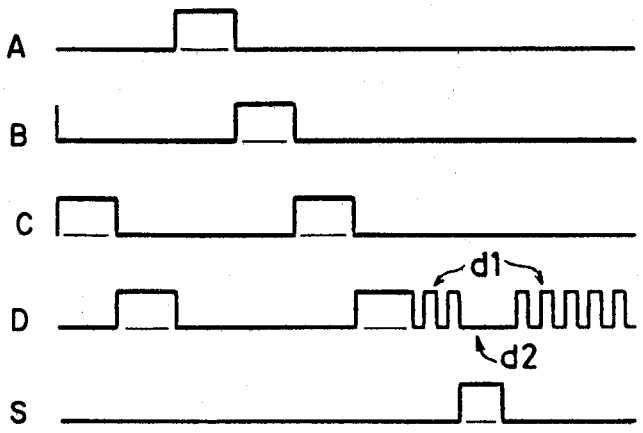
FIG. 5 is a depiction of waveforms to explain the operation of the control circuit depicted in FIG. 4.

Conditions during such printing operation are described in detail below referring to the waveforms of energizing signals to the energized poles A,B,C and D of stepping motor 6 and solenoid 9 of print hammer unit 8 as shown in FIG. 5. When an input command 15 is applied for instructing a quantity of rotation of print wheel 1 from its stopped state, control circuit 14 sequentially supplies driving signals to drive circuit 17 depending on detection signals from detector 16. As a result, signals shown as waveforms a (A), (B), (C) and (D) in FIG. 5 are supplied from drive circuit 17 to the windings of the corresponding energized poles A, B, C and D of stepping motor 6 so that the motor is energized in the sequence of the poles as C→D→A→B→C. When the energized poles are changed for one another, a quantity of rotation is caused, corresponding to the interval between the adjacent type elements on the print wheel. In this case, the rotational position of motor 6 energized through pole D is a final stop position to keep selected type element 4 in a position whereat element 4 is struck by hammer 10. When it is confirmed in terms of a detection signal from detector 16 that stepping motor 6 has come to a final stop position, control circuit 14 starts regulation to feed a chopping pulse signal (d1) to pole D. The pulse signal (d1) is necessary to hold stepping motor 6 in a steady state position and is so set that electric power consumption for the holding action is low.

Subsequently, an energizing signal shown at (S) in FIG. 5 is supplied to solenoid 9 through drive circuit 18 by control circuit 14. At the same time, the feeding of chopping pulse signal (d1) to stepping motor 6 is suspended by control circuit 14 as shown at d2 in FIG. 5, so that stepping motor 6 can be rotated in suitable direction by an external force. After the striking action of hammer 8 is completed, control circuit 14 resumes continuously supplying chopping pulse signal (d1) to stepping motor 6 to prepare for the selection of the following type element.

Figure 6:
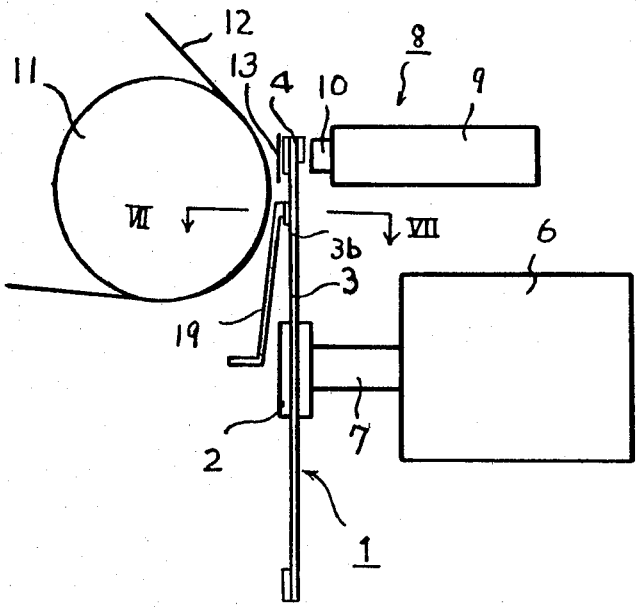
FIG. 6 is similar to FIG. 1, but showing a modified embodiment.
Figure 7:
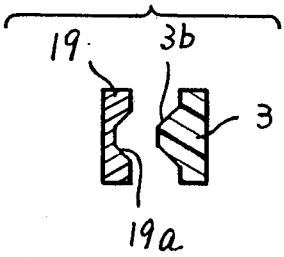
FIG. 7 is an enlarged end view of the positioning means and is taken along the line VII—VII of FIG. 6.

FIGS. 6 and 7 depict a printer wherein a positioning means is provided between a projection 3*b* on each spoke 3 and a recess 19*a* (see FIG. 7) on a guide member 19 which is secured on a carriage (not shown) in order to move a selected type element 4 toward a printing point on print paper 12. A positioning means similar to the one herein disclosed is disclosed in U.S. Pat. No. 3,983,985. In this printer, printing action and control operation similar to those described herein in reference to FIGS. 1, 2, 3, 4 and 5 are effected. The portions of the printer, which are shown in FIGS. 6 and 7 and correspond to those of the other printer shown in FIGS. 1, 2, 3, 4 and 5, are denoted by the same symbols for the same components.

As described above, printing is performed at an accurate printing point by the positioning means in the serial printer according to the present invention, thereby providing an orderly row of printed characters. Since the energize-hold operation of the stepping motor is suspended by the control circuit during the striking action of the print hammer, the spoke on the print wheel does not receive excessive force in the rotating direction due to the action of the positioning means. This results in greatly reducing the damage to the print wheel.

It is further understood by those skilled in the art that the foregoing description is a preferred embodiment of the invention, and that various changes and modifications may be made in the invention, without departing from the spirit and scope of the invention.

What is claimed is:

1. A serial printer for printing on a surface of a paper mounted on a platen, comprising a stepping motor having a stator and a rotor provided with a shaft which extends outwardly and rotates with said rotor;

a print wheel having a central part directly fixed on said shaft of said rotor and a plurality of spokes each of which has an end integral with said central part and another end provided with a portion bearing a particular type element, each type element on said print wheel capable of facing a printing point on said paper according to the rotation of said rotor;

a print hammer movable toward said printing point for striking a selected type element on said print wheel;

means for positioning accurately said selected type element struck by said print hammer so that said selected type element comes into contact with said printing point on said paper, said means co-acting with the spoke bearing said selected type element to be struck against said paper so as to guide said selected type element toward said printing point during the striking action of said print hammer; and control circuit means for selectively driving said printing hammer and selectively energizing said motor in order to rotate said print wheel to a position whereat said selected type element may be struck by said print hammer and in order to hold said selected type element at said position, said control means momentarily releasing the energization of said motor so as to completely release a holding force against said print wheel during the striking action of said print hammer, whereby said print wheel may be rotated slightly with said rotatable shaft when said positioning means moves said selected type element toward said printing point.

2. The printer of claim 1, wherein said control means starts regulation to feed a chopping pulse signal to said motor for holding said selected type element at said position by a detection signal from a detector detecting that said motor has come to a final stop position, and said control means suspends the feeding of chopping pulse signal to said motor for releasing the energization of said motor so as to completely release a holding force against said print wheel during the striking action of said print hammer, and said control means resumes continuously supplying chopping pulse signal to said motor when the striking action of said print hammer is completed.

3. The printer of claim 2, wherein said positioning means comprises a recess provided on the tip of said print hammer and a plurality of projections, each of which is provided on the side of each said spoke opposite to said type element, and said recess engages with said projection on said spoke bearing said selected type element when said type element is struck by said print hammer, whereby said selected type element is guided accurately toward said printing point.

4. The printer of claim 2, wherein said positioning means comprises a part of each of said spoke on said print wheel and a part of a guide member located between said platen and said print wheel.

5. The printer of claim 4, wherein said positioning means comprises a recess provided on said guide member and a plurality of projections, each of which is provided on the side of each said spoke against said guide member, each projection engagable with said recess on said guide member when said type element on the same spoke is struck by said print hammer, whereby said selected type element is guided accurately toward said printing point.

6. The printer of claim 2, wherein said motor is a stepping motor characterized by a plurality of steady state positions, the number of said steady state positions being equal to that of said type elements on said print wheel.

7. The printer of claim 6, wherein said positioning means comprises a part of said print hammer and a part of each of said spokes on said print wheel.

8. The printer of claim 6, wherein said positioning means comprises a recess provided on the tip of said print hammer and a plurality of projections, each of which is provided on the side of each of said spokes, opposite to said type element which is struck by said print hammer, and said recess engages with said projection on said spoke bearing said selected type element when struck by said print hammer, whereby said selected type element is guided accurately toward said printing point.

9. The printer of claim 6, wherein said positioning means comprises a part of each of said spokes on said print wheel and a part of a guide member located between said platen and said print wheel.

10. The printer of claim 9, wherein said positioning means comprises a recess provided on said guide member and a plurality of projections, each of which is provided on the side of each said spoke against said guide member, each projection engagable with said recess on said guide member when said type element on the same spoke is struck by said print hammer, whereby said selected type element is guided accurately toward said printing point.

* * * * *